US005255934A

United States Patent [19]

Wilson

[11] Patent Number: 5,255,934

[45] Date of Patent: * Oct. 26, 1993

[54] WHEELCHAIR SEAT CONVERTIBLE TO TOILET SEAT

[75] Inventor: Harold R. Wilson, Holland, Mich.

[73] Assignee: Love Lift, L.P., Holland, Mich.

[ * ] Notice: The portion of the term of this patent subsequent to May 12, 2009 has been disclaimed.

[21] Appl. No.: 749,153

[22] Filed: Aug. 23, 1991

Related U.S. Application Data

[63] Continuation-in-part of Ser. No. 484,570, Feb. 23, 1990, Pat. No. 5,112,076.

[51] Int. Cl.[5] ..... A61G 5/10; A61G 5/04

[52] U.S. Cl. ..... 280/657; 280/304.1; 180/907; 4/480; 297/DIG. 4; 297/344.1; 414/921

[58] Field of Search ..... 280/638, 657, 250.1, 280/304.1; 180/907, 65 R, 6.5; 4/254; 5/480, 81.1; 297/345, DIG. 4; 414/921

[56] References Cited

U.S. PATENT DOCUMENTS

| | | | |
|---|---|---|---|
| 181,397 | 8/1876 | Beyron | 4/254 |
| 503,105 | 8/1893 | Tingley | 5/81 R X |
| 1,094,117 | 4/1914 | Butler | 5/86 |
| 2,339,007 | 1/1944 | Gahm | 5/81 R X |
| 2,498,853 | 2/1950 | Hassold et al. | 5/86 |
| 2,595,651 | 5/1952 | Feist | 5/86 |
| 2,681,455 | 6/1954 | Schwartz | 5/86 |
| 2,792,052 | 5/1957 | Johannesen | 5/83 X |
| 2,892,506 | 6/1959 | Slater | 5/81 R |
| 3,099,020 | 7/1963 | Garfield et al. | 5/81 R |
| 3,285,619 | 11/1966 | Kitrell et al. | 5/81 R |
| 3,394,933 | 7/1968 | Benoit | 5/81 R |
| 3,611,449 | 10/1971 | Berry | 4/480 |
| 3,623,169 | 11/1971 | James | 5/81 R |
| 3,629,880 | 12/1971 | van Rhyn | 5/86 |
| 3,790,974 | 2/1974 | Johansson | 5/86 |
| 3,905,436 | 9/1975 | Karchak et al. | 180/6.5 |
| 3,917,076 | 11/1975 | Campbell | 5/86 X |
| 3,940,808 | 3/1976 | Petrini | 5/86 |
| 3,996,632 | 12/1976 | Bakker nee Viel | 5/83 |
| 3,999,227 | 12/1976 | Ingemansson | 5/86 |
| 4,007,959 | 2/1977 | Juergens . | |
| 4,010,499 | 3/1977 | Davis et al. | 5/81 R |
| 4,067,409 | 1/1978 | DiMatteo et al. . | |
| 4,157,593 | 6/1979 | Kristensson | 5/81 R |
| 4,193,147 | 3/1980 | Fischer | 5/81 R |
| 4,240,169 | 12/1980 | Roos | 5/60 |
| 4,255,823 | 3/1981 | Boyer et al. | 5/81 R |
| 4,266,305 | 5/1981 | Kavaloski et al. | 297/DIG. 4 X |
| 4,278,387 | 7/1981 | Seguela et al. | 414/462 |
| 4,375,840 | 3/1983 | Campbell | 180/6.5 |
| 4,399,572 | 8/1983 | Johansson | 5/81 R |
| 4,456,086 | 6/1984 | Wier et al. . | |
| 4,477,117 | 10/1984 | Higgs | 297/45 |

(List continued on next page.)

FOREIGN PATENT DOCUMENTS

| | | | |
|---|---|---|---|
| 0067069 | 12/1982 | European Pat. Off. | 280/304.1 |
| 1316673 | 6/1987 | U.S.S.R. | 180/6.5 |
| 2135183 | 8/1984 | United Kingdom | 280/250.1 |

*Primary Examiner*—Brian Johnson

*Attorney, Agent, or Firm*—Flynn, Thiel, Boutell & Tanis

[57] ABSTRACT

A wheelchair including a wheeled base assembly provided with an upright assembly thereon, the latter including a pair of vertical post arrangements which are provided adjacent front corners of the wheelchair and are vertically extendible and retractable. The upright assembly includes a pair of generally parallel and approximately horizontal arms which are mounted adjacent upper ends of the upright post arrangements. A seat assembly is removably attached to and positioned between the arms. The seat assembly includes a seat portion defined by normally vertically superimposed upper and lower seat subassemblies. The upper subassembly has an enlarged opening formed centrally therethrough. The lower subassembly can be detached and moved from beneath the upper subassembly to permit the seat portion of the wheelchair to be positioned directly over and utilized in conjunction with a conventional toilet so as to not require removal of the occupant from the seat assembly.

23 Claims, 9 Drawing Sheets

U.S. PATENT DOCUMENTS

| | | | |
|---|---|---|---|
| 4,514,867 | 5/1985 | Jensen | 297/DIG. 4 X |
| 4,527,829 | 7/1985 | Fanslau et al. | 297/17 |
| 4,569,094 | 2/1986 | Hart et al. | 5/81 R |
| 4,592,562 | 6/1986 | Strautnieks et al. | 280/250.1 |
| 4,631,761 | 12/1986 | Lederman | 5/81 R |
| 4,643,481 | 2/1987 | Saloff et al. | 297/DIG. 4 X |
| 4,669,943 | 6/1987 | Zamotin | 414/343 |
| 4,704,749 | 11/1987 | Aubert | 5/81 R |
| 4,719,655 | 1/1988 | Dean | 5/81 R |
| 4,737,997 | 4/1988 | Lamson | 280/304.1 |
| 4,856,123 | 8/1989 | Henderson et al. | 5/81 R |
| 4,862,997 | 9/1989 | Eberle | 187/11 |
| 4,890,853 | 1/1990 | Olson | 5/81 R X |
| 5,039,165 | 8/1991 | Rothman et al. | 297/DIG. 4 X |
| 5,112,076 | 5/1992 | Wilson | 280/657 |

WHEELCHAIR SEAT CONVERTIBLE TO TOILET SEAT

CROSS REFERENCE TO RELATED APPLICATION

This application is a continuation-in-part of my copending application Ser. No. 07/484570, filed Feb. 23, 1990 now U.S. Pat. No. 5,112,076 and entitled "WHEELCHAIR WITH REMOVABLE SEAT".

FIELD OF THE INVENTION

This invention relates to an improved wheelchair for use by invalid or handicapped persons, which wheelchair provides significantly increased mobility and transferability of the occupant while permitting use in conjunction with a standard toilet.

BACKGROUND OF THE INVENTION

Numerous wheelchairs have been developed for both residential and commercial use, including motorized wheelchairs. Some of these have provided limited vertical adjustability, and others have attempted to permit transfer of a occupant either onto or off of the wheelchair, such as by providing a removable seat. These prior structures, however, have proven to be less than desirable since most have not provided both a durable and simple structure while permitting vertical adjustability, nor have they provided a structure which can be safely and conveniently manipulated to permit transfer of the occupant, such as when the seat is being transferred.

Rather, particularly in medical facilities, transfer of patients is still accomplished primarily by using lift devices wherein a wheeled frame is provided with a single vertically extendible upright post having a support arm projecting cantilevered from the upper end thereof, which arm at its free end has a slinglike flexible seat suspended therefrom for supporting a patient. Such mechanisms do not function as wheelchairs, however, but solely as lifting and transfer devices. Further, such devices are frightening to the patient since the patient is supported solely by the suspended flexible seat arrangement and does not have the comfort and security of being seated within a chair structure.

With respect to wheelchairs which have been developed for home use, while many such chairs have been motorized, nevertheless the known chairs have either provided no or only limited capability of permitting the occupant to raise and lower the seat, and have not permitted transfer from the chair. While various complex specialized chairs and transfer mechanisms have been developed to assist in transferring the patient into or out of a vehicle, including transfer to or from the vehicle and the wheelchair, nevertheless most of these devices have been extremely specialized, cumbersome and expensive, and hence have not permitted simplified and efficient transfer from a seemingly conventional wheelchair.

One of the primary disadvantages associated with the typical wheelchair is the inability to use the wheelchair in conjunction with a standard toilet. Most wheelchair occupants must be physically transferred from the wheelchair to the toilet, and then back to the wheelchair. This transfer typically requires assistance of a second person, or at the least the providing of numerous support bars and rails assuming that the wheelchair occupant has sufficient mobility as to be able to manage such transfer. Needless to say, such transfer, whether with or without a second person, is difficult to accomplish and can create a hazard for the wheelchair occupant. Further, such transfer necessarily requires significant space around the toilet to accommodate the wheelchair and any person assisting in the transfer, which space is not always available.

Accordingly, it is an object of the present invention to provide an improved wheelchair which is believed to represent a significant improvement over many of the wheelchairs and lifting devices which have been heretofore utilized, and which overcomes many of the disadvantageous mentioned above.

More specifically, it is an object of this invention to provide an improved wheelchair which can be utilized in conjunction with a standard toilet, and which overcomes many of the disadvantageous associated with standard wheelchairs described above, particularly by eliminating the need to transfer the occupant between the wheelchair and the toilet.

SUMMARY OF THE INVENTION

The improved wheelchair includes a wheeled base assembly provided with an upright assembly thereon, the latter including a pair of telescopic upright post arrangements provided adjacent opposite sides of the wheelchair. The upright assembly includes a pair of arms which are secured and cantilevered rearwardly from upper ends of the upright post arrangements. A seat arrangement is removably attached to and positioned between the arms to facilitate transferring of an occupant, along with the seat assembly, either to or from the wheelchair.

In the improved wheelchair, as aforesaid, the seat assembly is suspended from the arms by suspension elements which are coupled between the seat and the arms, such as at locations disposed adjacent the front ends of the arms. The suspension elements are provided with couplings at opposite ends which permit them to be readily detached from the arms to facilitate transfer of the occupant when desired. The region of the wheelchair between the upright posts and the arms is free of obstructions so as to permit ready access of the occupant into the seat from the front side thereof when it is mounted on the wheelchair, and to also permit the occupant and the seat to be readily transferred onto or off from the wheelchair from the rear side thereof.

In the improved wheelchair of the present invention, the seat includes upper and lower seat portions disposed in direct overlying and supportive engagement with one another for normally supporting the wheelchair occupant. The upper seat portion extends between opposite side seat frame elements and is constructed of a flexible sheetlike material, such as vinyl or fabric, and has a suitable central opening therethrough. The lower seat portion is removably secured to the side frame elements and extends therebetween for disposition directly under the upper seat portion. The wheelchair is positionable over a conventional toilet so that the seat is disposed directly above the toilet. The extendible/contractible posts of the wheelchair are lowered until the seat contacts the top of the toilet and the occupant's weight is at least significantly transferred to the toilet, thereby relieving the tension in the straps which suspend the seat. This enables the lower seat portion to be released from the seat frame, following which the posts are extended upwardly to raise the upper seat portion which then entirely supports the occupant, with the lower seat portion remaining supported on the toilet. The lower seat portion can then be removed from the toilet and temporarily stored in adjacent relationship, following which the posts are lowered until the upper seat portion is disposed directly over the toilet. The lower seat portion is thereafter reassembled to the seat utilizing substantially the reverse sequence to that outlined above.

Other objects and purposes of the wheelchair according to the present invention will be apparent to persons familiar with structures of this general type upon reading the following specification and inspecting the accompanying drawings.

Figure 1:
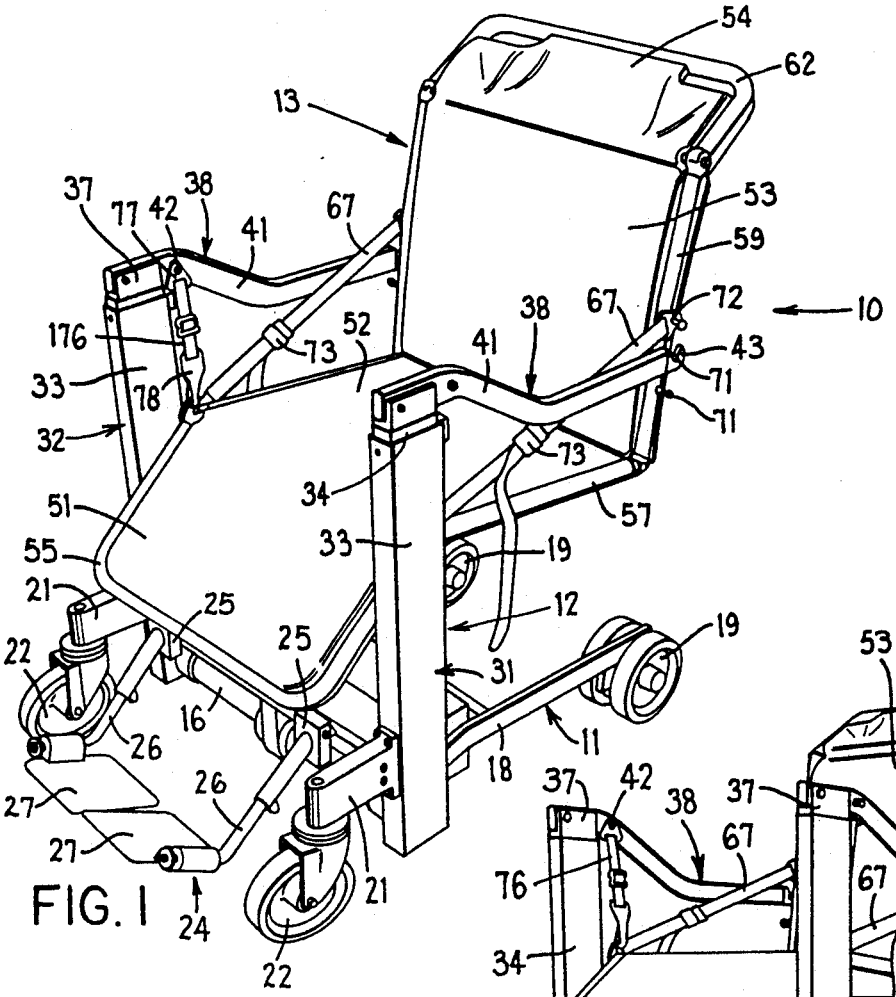
FIG. 1 is a perspective view of a first variation of the wheelchair as shown in its lowered position.

Certain terminology will be used in the following description for convenience in reference only, and will not be limiting. For example, the words "upwardly", "downwardly", "rightwardly" and "leftwardly" will refer to directions in the drawings to which reference is made. The word "front" will refer to the side of the wheelchair through which the occupant normally enters or exits the chair, this being the left side in FIGS. 1 and 2. The words "inwardly" and "outwardly" will refer to directions toward and away from, respectively, the geometric center of the wheelchair and designated parts thereof. Said terminology will include the words specifically mentioned, derivatives thereof, and words of similar import.

DETAILED DESCRIPTION

Description of FIGS. 1–8

FIGS. 1–8 illustrate a first variation of a wheelchair 10 according to the present invention, which wheelchair 10 is particularly desirable for use in medical facilities such as hospitals, nursing homes and the like.

The wheelchair 10 includes a wheeled base assembly 11 having an upright assembly 12 mounted thereon and projecting upwardly therefrom. This upright assembly 12 in turn mounts thereon a removable seat assembly 13, the latter being used for receiving an occupant both for transporting by the wheelchair and transfer to and from the wheelchair.

The wheeled base assembly 11 includes a generally U-shaped base which is disposed close to the floor and opens rearwardly. The U-shaped base has the bight thereof defined by a support tube 16 which extends horizontally and transversely across the wheelchair adjacent the front side thereof. This support tube has opposite ends thereof mounted within brackets 17 which are rigidly secured to the forward ends of a pair of generally parallel and rearwardly projecting cantilevered side legs 18. These side legs 18 at their rearward or free ends mount rear wheels assemblies 19, which assemblies preferably each constitutes a pair of wheels disposed in straddling relationship to the respective side leg 18.

The base assembly 11 also includes a pair of front side legs 21 which project forwardly a small extent in generally parallel relationship, and are forwardly cantilevered so as to mount thereunder, adjacent the free end, a front support roller 22, the latter preferably being of the caster type. The front and rear wheels 22 and 19 are of substantially the same diameters.

Figure 2:
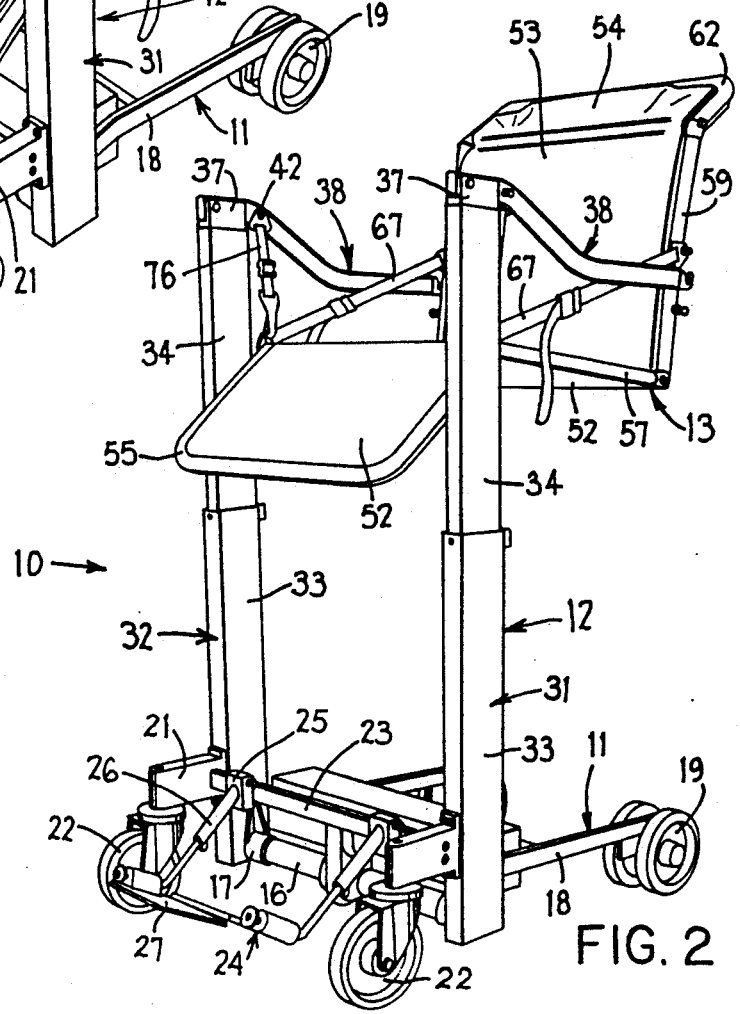
FIG. 2 shows the wheelchair of FIG. 1 in its uppermost position.
Figure 3:
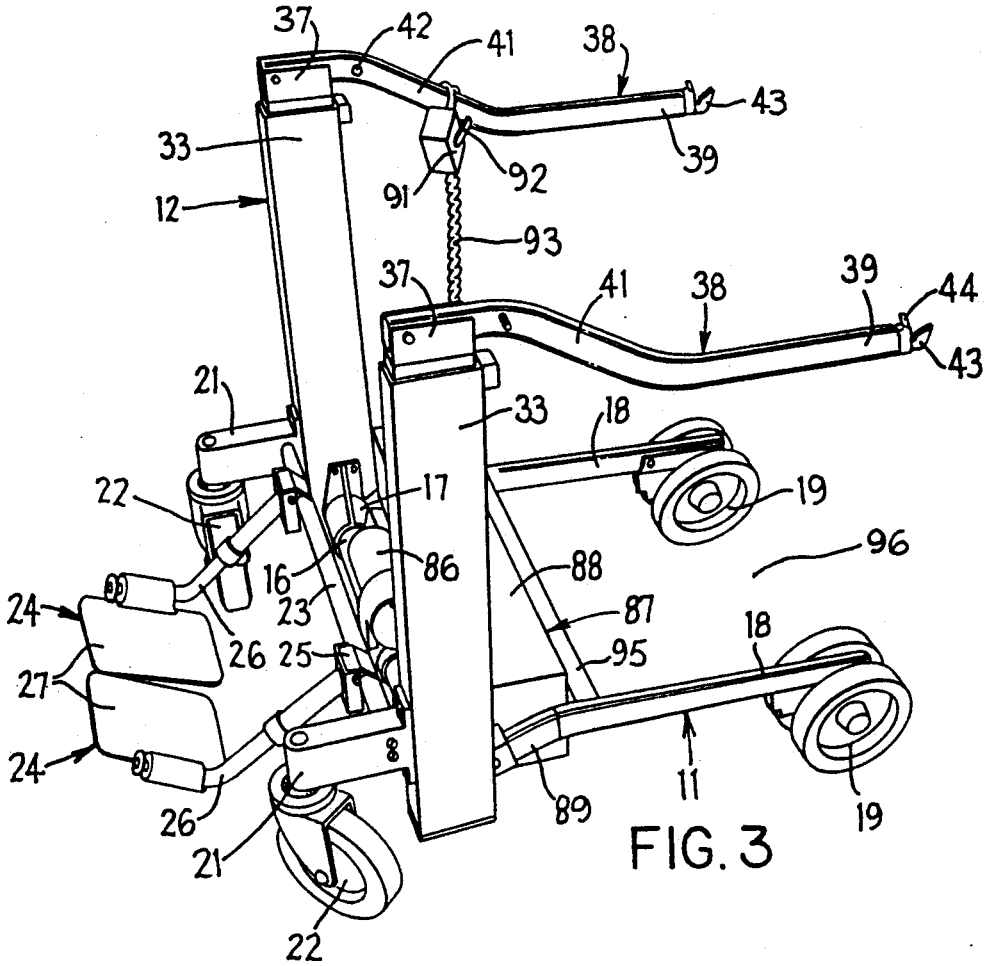
FIG. 3 shows the wheelchair with the seat assembly removed.

The front support legs 21 are fixedly secured to the lower end of the upright assembly 12, the latter in turn having the brackets 17 fixedly secured thereto, as illustrated by FIG. 2. A support bar 23 which is spaced slightly forwardly from and vertically above the support tube 16 extends between and is rigidly joined to the front support legs 21.

The support bar 23 mounts thereon right and left foot supports 24. Each of these foot supports includes a bracket 25 which removably attaches to the bar 23 and has a forwardly and downwardly projecting arm 26 which, at its outer end, pivotally supports thereon a conventional foot plate 27. The structure of the foot support 24 is conventional and well known.

Considering now the upright assembly 12, it is defined principally by a pair of vertically elongate and telescopic support post assemblies 31 and 32 which are disposed on opposite sides of the wheelchair in the vicinity of the front corners thereof. The assemblies 31 and 32 are substantially identical (i.e., mirror images of one another).

The assembly 31 and 32 each includes a vertically elongate lower support post 33 which has the lower end thereof rigidly secured to the base, such as to the front support leg 21 and the bracket 17 as discussed above. The lower part of the post 33 effectively functions as part of the rigid base. This post 31 is of tubular construction and projects vertically upwardly a significant extent, and vertically slidably telescopically receives therein an upper support post 34.

The upper and lower support posts 34 and 33, respectively, are each preferably of tubular construction so as to maximize the strength thereof, and the upper post 34 at the lower front side thereof carries a first guide roller 35 which vertically rollingly moves along the inside front wall of the lower post 33. This lower post 33 in turn mounts a further guide roller 36 at the upper end thereof for rolling engagement with the rear exterior side of the upper post 34. These rollers facilitate free vertical displacement of the upper post 34 during raising and lowering, and at the same time provide for maximum resistance to the load-imposed moments imposed on the lower post by the upper post when the wheelchair has an occupant supported therein. The inner upper end of post 33, and the lower outer end of post 34, also preferably have now plastic (such as DELRIN) slide bearings fixed thereto to facilitate the vertical sliding between the posts.

The support posts 33 and 34 preferably have rectangular cross sections and also preferably have a tubular cross sectional dimension in the front-to-rear direction which is substantially greater (such as about a 2:1 ratio) than the tubular cross sectional dimension in the sideward direction. This permits the overall sideward dimension or width of the support posts to be minimized so that the overall wheelchair width can be minimized but at the same time provides the support tubes with significant bending strength so as to withstand the significant bending loads imposed on the support posts when the seat is occupied.

Each upper post 34, at the free upper end thereof, mounts a bracket 37 which is rigidly attached to the forward end of a seat support arm 38, which support arm projects rearwardly in a cantilevered fashion along the side of the chair so as to terminate in a free end 39. The support arms 38 project rearwardly from the upper posts 34 in generally parallel relationship and are sidewardly spaced apart so that they are generally disposed approximately over the rear side legs 18, whereby the arms 38 accommodate the seat assembly 13 therebetween, as explained below.

The rearward portions of the support arms 38 are disposed at an elevation such that they can function as armrests for the occupant of the wheelchair. However, the arms 38, in the forward portions thereof, are provided with upwardly inclined parts 41 which are provided so that the forward ends of the arms, at the points of attachment to the brackets 37, are somewhat elevated. This permits the post assemblies 31 and 32 to have increased vertical displacement to enable the wheelchair to be vertically displaced between the lowered and raised positions illustrated by FIGS. 1 and 2, respectively.

Each of the support arms 38 has, in the vicinity of the front end thereof, a pinlike seat-support element 42 projecting inwardly from the inner side thereof. The rear free end of each arm 38 also has a support catch or claw 43 which defines an upwardly opening notch 43*a*, which notch is normally maintained closed by a spring 45 or gravity urged latch 44 which is movably, here pivotally, supported on the respective support arm.

Figure 4:
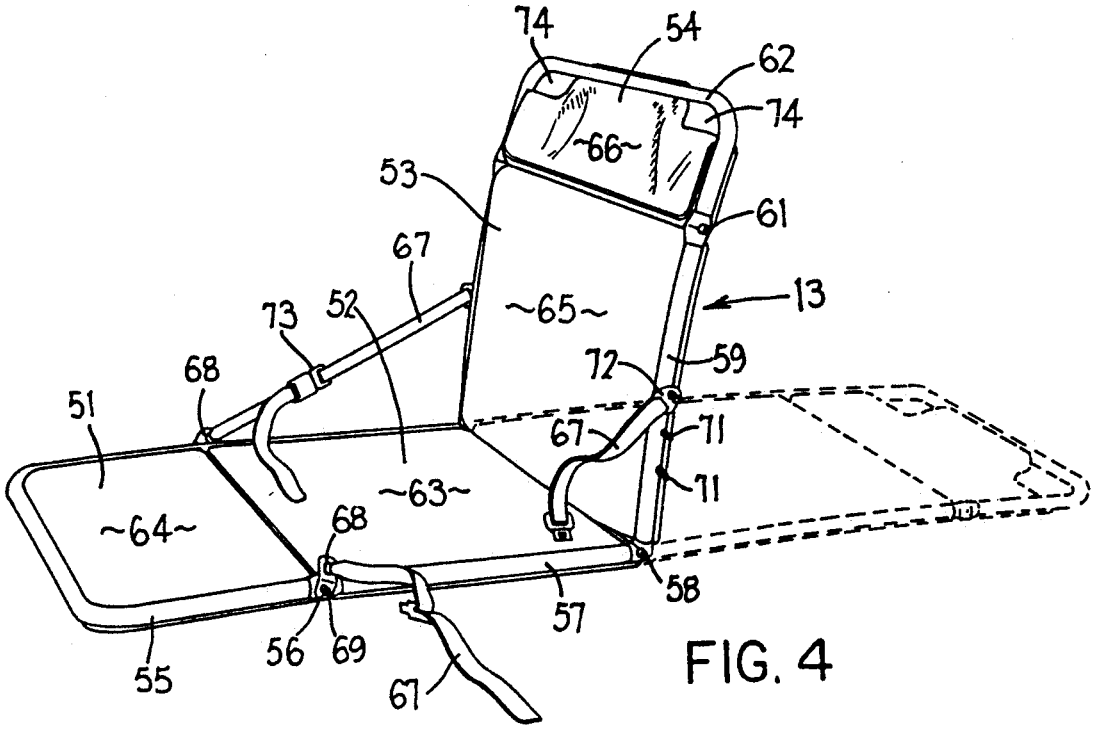
FIG. 4 shows the removed seat assembly.

The seat assembly 13, as illustrated by FIG. 4, includes a leg support portion 51 hingedly joined to a seat portion 52, which in turn is hingedly joined to a backrest portion 53, and it in turn is hingedly joined to a top portion 54 which functions either as a headrest or as a handle. The seat assembly can be formed so that the seat portion and backrest portion project transversely as indicated by solid lines in FIG. 4, or can be flattened so as to define a flat stretcher as indicated by broken lines.

To provide this preferred structure, the footrest portion 51 includes a tubular frame member 55 which defines the lower and opposite side edges, and these side frame edges are joined via a horizontal hinge 56 to the front ends of side rails 57 associated with the seat portion 52. The rearward ends of side rails 57 are joined by a hinge 58 to the lower ends of the side rails 59 defining the backrest portion 53. These side rails 59 at their upper ends are joined by a hinge 61 to the U-shaped frame element 62 which defines the side and top edges of the top portion 54. The hinges 56, 58 and 61 are all preferably friction type hinges which are sufficiently snug so as to permit the adjacent portions to remain in the selected relative position, but permit the adjacent portions to be relatively hinged by application by suitable manual force.

All of the portions of the seat are also preferably provided with a suitable covering. For example, the seat portion 52 has a support or covering 63 which is stretched tautly between the side rails 57 so as to effectively function as a seat for the wheelchair occupant, and a similar covering 64 extends across the foot portion 51. The covering 63 and 64 can be part of one integral piece of material if desired. A further covering 65 extends between the side rails 59 to define the backrest, and a similar covering 66 is supported by the top rail 62 to define the top portion of the seat assembly. These coverings are all preferably of a flexible fabric-like or plastic material to provide limited yieldability or resiliency so as to improve the comfort of the wheelchair occupant. Further, these coverings can all be attached to the frame in a removable manner, if desired, to facilitate replacement of the coverings.

To permit the seat and back portions 52 and 53, respectively, to be supported and maintained in transverse relationship so as to support an occupant, such as illustrated by the solid line position of FIG. 4, the seat assembly also includes a pair of side supports 67 which are provided for joining the portions 52 and 53 together in the desired angled relationship. Each side support 67 is preferably formed as an elongate flexible strap having, at the lower front end thereof, a clip 68 provided with an opening therethrough for releasable engagement with a pinlike attachment element 69 which projects sidewardly from the seat rail 57 adjacent the front end thereof. This support element 69 in the illustrated embodiment is defined by the sidewardly projecting end of the hinge pin or bolt 56, but such element could be separate from the hinge pin if desired.

The side rail 59 of the backrest 53 has a plurality of similar pinlike support elements 71 projecting sidewardly therefrom at spaced relationships therealong, with the uppermost of these elements 71 being approximately midway between the ends of the side rail 59. The rear end of the strap 67 has a clip 72 having an opening therethrough for engagement with a selected one of the elements 71, with the clip 72 and selected element 77 being secured by a removable retaining ring. The support strap 67 is preferably formed in two pieces which are joined together by a conventional adjustable but releasable clasp 73, which clasp permits the length of the strap 67 to be adjusted so as to permit the angle between the seat and back portions to be selected, but at the same time the clasp 73 can be easily manually separated, such as illustrated by the left side support strap 67 in FIG. 4. The structure of such clasp is conventional so that a detailed explanation thereof is believed unnecessary.

In use, such as when the seat assembly is mounted on the wheelchair, the legs support portion 51 can be pivoted downwardly if desired to provide support beneath the legs, such position being illustrated by FIGS. 1 and 2. Further, the top portion 54 can be tilted rearwardly so as to be in transverse relationship to the backrest portion 53, whereby this top portion 54 and specifically the end rail 62 can be used as a handle to permit a person, such as a hospital technician or aid, to grasp the rail 62 so as to propel and control the wheelchair. For this purpose, the covering 66 is preferably provided with cutouts 74 at the corners to function as hand holes.

To secure the seat assembly 13 to the upright assembly 12, the seat assembly 13 is secured or joined to the pair of cantilevered support arms 38 adjacent the front and rear ends thereof so as to effectively define a four-point support. The two rearward-most support points are defined by the claws 43 defined at the free rearward ends of the support arms 38, which claws 43 receive in the grooves or notches thereof a pair of the support pins 71 which project outwardly from opposite sides of the backrest 53. The pins 71 are securely held within the claws by means of the latch elements 44, whereby removal of the pins from the claws is possible only by first manually pivoting the latch elements 44 forwardly so as to release them.

Figure 5:
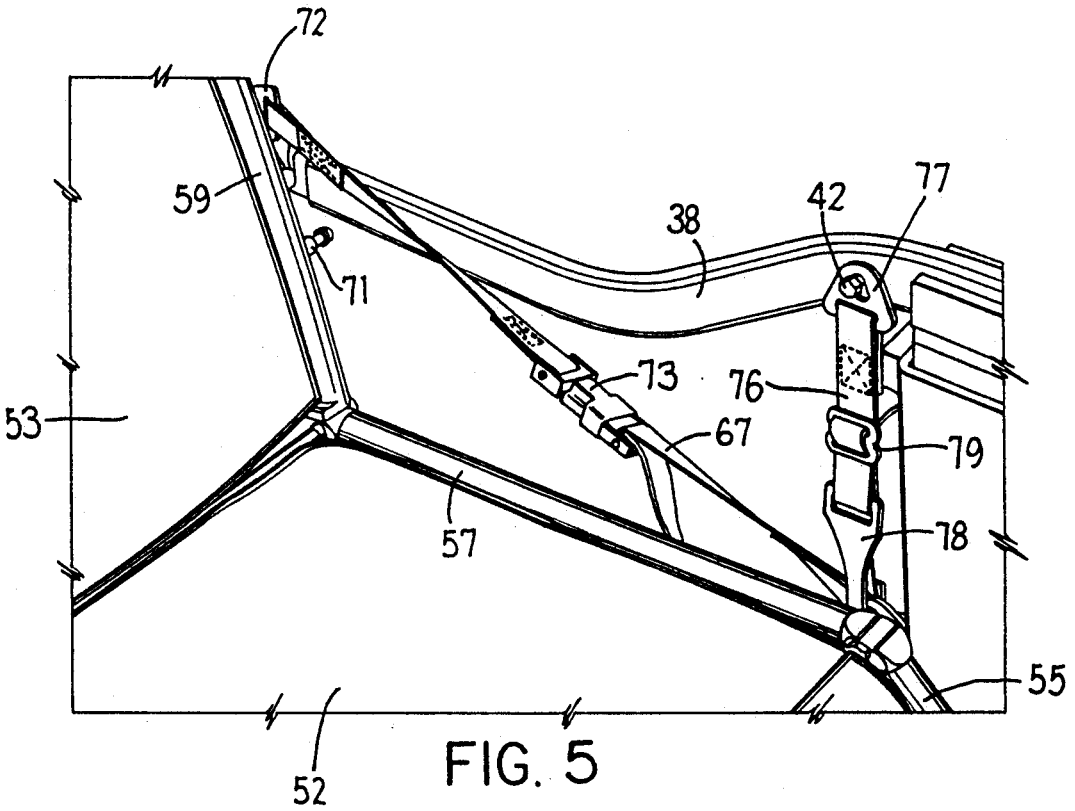
FIG. 5 is a fragmentary perspective view showing the attachment structure for the removable seat assembly.
Figure 8:
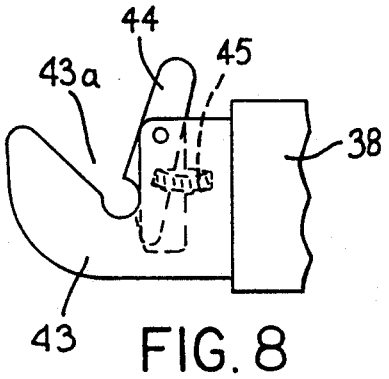
FIG. 8 is an enlargement of the catch at the end of the support arm.
Figure 7:
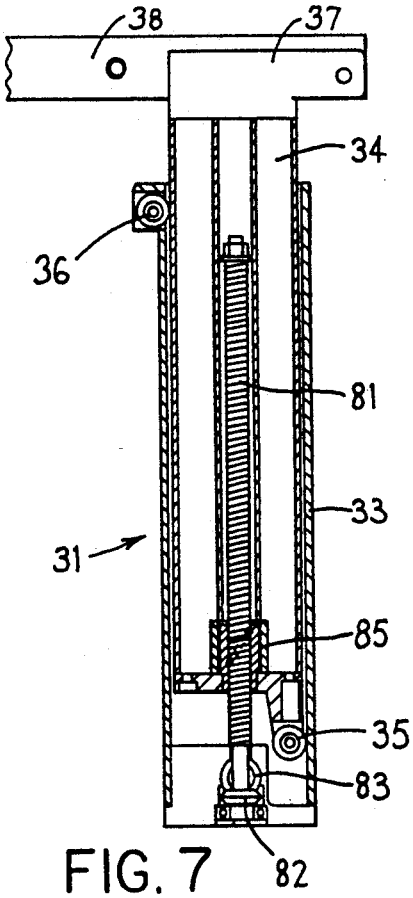
FIGS. 6 and 7 are sectional elevational views of the extendible post arrangement.
Figure 6:
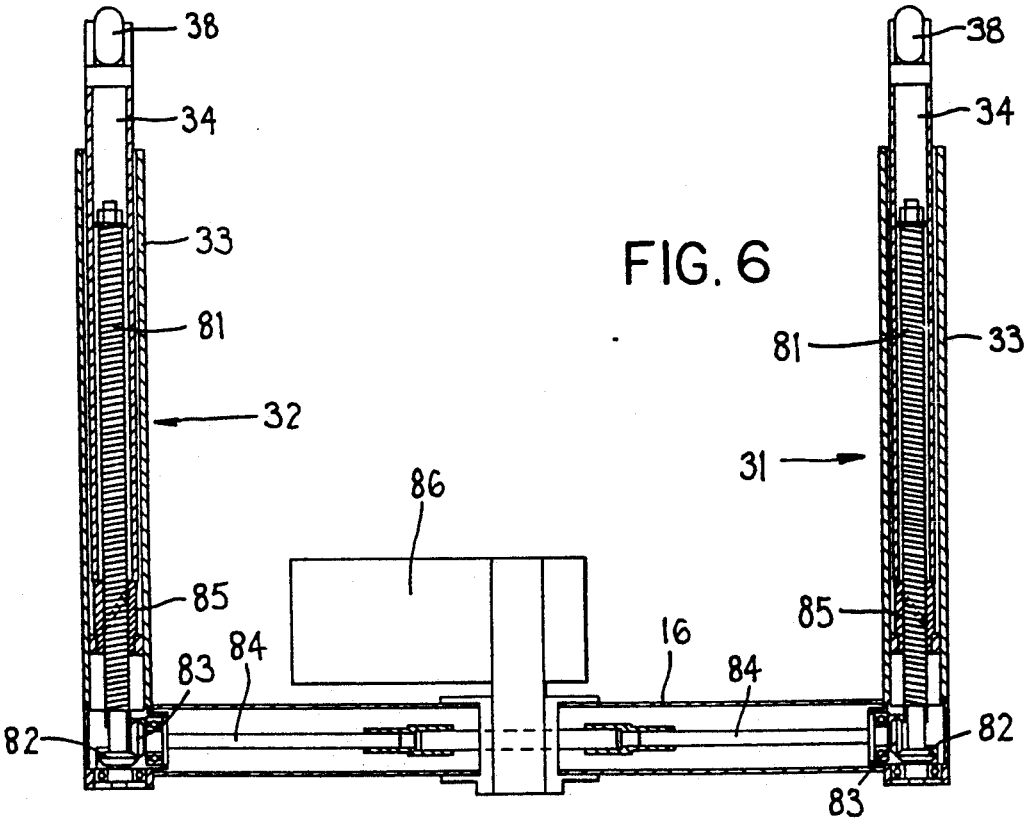

The front of the seat assembly is suspended from the support arms 38 adjacent the forward ends thereof. For this purpose each support arm 38 has a flexible support element or strap 76 which, as shown in FIG. 5, has a clip 77 at its upper end provided with a keyhole-like slot or opening therethrough for accommodating the support pin 42 which projects inwardly from the side of the support arm 38. This support strap 76 at its lower end has a manually-releasable springlike clip 78 which can be engaged through an opening formed in the clip 68 provided on the front end of the side support strap 67. This suspension strap 76 also preferably has a conventional adjustment buckle 79 associated therewith so as to permit the elevation of the front of the seat portion to be adjusted relative to the support arm 38. Due to the manner in which the clip 78 engages the clip 68, the suspension strap 76 will normally remain attached to the seat assembly, and the disattachment point occurs between the clip 77 and the support pin 42. However, the suspension straps 76 have been eliminated from FIG. 4 for clarity of illustration.

To permit powered raising and lowering of the support post assemblies 31 and 32 and the seat assembly 13 which is mounted from the arms 38, each of the post assemblies includes an actuator which, in the illustrated embodiment, includes a vertically elongate screw shaft 81 which projects vertically throughout the extent of the lower support post 33. This threaded shaft 81 is rotatably supported in the post 33 and, adjacent its lower end, has a bevel gear 82 thereon which meshes with a further bevel gear 83 secured to the adjacent end of a drive shaft 84, the latter being rotatably supported within and extending along the support tube 16. The threaded shaft 81 is threadably engaged within a ball nut 85 which is fixed to and defines the lower end of the upper post 34 so that rotation of the drive shaft 81 in one direction or the other causes corresponding vertical displacement of the upper post 34 either upwardly or downwardly, respectively.

The drive shaft 84 is coupled to a drive motor 86, such as a conventional reversible gear motor, the latter being mounted on the support tube 16.

To permit powering of the drive motor 86, the base assembly mounts thereon a power supply 87 which includes a generally boxlike housing 88 or tray which is positioned directly behind the support tube 16 and extends transversely between and is supported on the opposed side legs 18. The housing 88, which normally includes a removable cover, is preferably provided with yokelike side handles 89 which are formed so as to overlie the side legs 18 and hence permit the power supply 87 to be securely supported thereon but easily removed therefrom.

This power supply 87 includes a conventional power source such as a 12-volt battery, the latter being coupled through suitable cables and separable connections, all of a conventional nature, to the drive motor 86.

To control energization of the drive motor 86 from the power source 87, the wheelchair is provided with a control box 91 having a conventional three-position switch 92, such as a toggle switch, which can be manually activated by the wheelchair assistant so as to drive the motor either in a forward or a reverse orientation so as to cause respective raising or lowering of the support post assemblies 31 and 32. This control box 91 is preferably joined to the control circuitry disposed within the power source 87 by a flexible stretch cable 93 to facilitate it to be lifted upwardly for easy access by the wheelchair assistant, but also enabling it to be readily stored on or attached to the power source 87 if desired.

The base of the wheeled base assembly is also provided, adjacent or slightly rearwardly of the power supply 87, with a reinforcing rod 95 extending transversely between and rigidly joined to the opposed side legs 18. However, the region 96 which is located rearwardly of this cross bar 95 but between the opposed side legs 18 opens freely rearwardly between the sidewardly spaced rear wheel assemblies 19. Further, the region which is located vertically between the lower side legs 18 and the support arms 38, which region is disposed rearwardly of the post assemblies 31 and 32, is freely open and accessible from both sides and from the rear.

Operation

The wheelchair is typically in the lowered position illustrated by FIG. 1 when utilized for transporting an occupant. With an occupant in the chair, the assistant grasps the handle 62 and pushes the chair so as to wheel the occupant to a desired location.

If it is desired to transfer the occupant from the chair onto another surface, such as a bed which is typically at an elevation higher that the seat portion 52, the wheelchair is initially positioned adjacent the bed so that the back of the wheelchair is adjacent the side of the bed. The assistant then activates the switch 92 so as to raise the support posts 31 and 32 until the seat portion 52 is at an elevation slightly above the upper surface of the bed. The assistant then manually pushes the wheelchair backwardly so that the rear legs 18 project under the bed, which rearward movement occurs until the side of the bed substantially abuts the vertically extended post assemblies 31 and 32. At this time, or slightly therebefore, the assistant may swing the leg support portion 51 of the seat assembly upwardly so as to be approximately aligned with the seat portion 52. After the wheelchair has been pushed rearwardly so that the side of the bed substantially abuts the inner surfaces of the post assemblies 31 and 32, this hence results in the seat portion 52 being disposed directly over but slightly above the upper surface of the bed. The operator then activates switch 92 so that the drive motor is energized to effect lowering of the post assemblies 31 and 32, which lowering continues until the seat portion 52 initially contacts the upper surface of the bed. The posts are then lowered a small additional amount so as to relieve the tension in the front seat support straps 67. During this lowering, the latches 44 are also manually released, whereupon the pins 71 lift upwardly out of the claws 43. The assistant then disconnects the clips 77 on the suspension straps 76 from the support pins 42, whereby the seat assembly is totally disconnected from the wheelchair and is supported directly on the upper surface of the bed. The assistant then moves the wheelchair, as appearing in FIG. 3, out of the way so as to provide full access to the bed-supported seat assembly and the occupant seated thereon.

The assistant then horizontally pivots the seat assembly so that the seat portion 52 and the attached leg support portion are rotated substantially 90 degrees so as to extend lengthwise of the bed. The assistant then provides support with one hand behind the backrest 53, and then releases the clasps 73 associated with the side straps 67, following which the assistant partially supports the backrest 53 and assists in controlling backward pivoting thereof so that the seat assembly and the occupant are lying generally flat on the bed, such as illustrated by the dotted position of the seat assembly in FIG. 4. When in this latter position, the assistant then slides or rolls the occupant partially onto the bed, and then slides the flattened seat assembly out from beneath the occupant, thereby leaving the occupant properly positioned on the bed.

Thereafter the seat assembly can be reattached to the wheelchair if desired, or alternatively the seat can be left in the room for use with the same occupant, and the wheelchair then moved to a further location and a different seat assembly attached thereto for use with a different occupant.

If it is desired to move an occupant from a bed into the wheelchair, then the sequence for doing such is basically the reverse of the sequence described above.

While the operation of transferring a patient from the wheelchair onto a bed or other surface, and vice versa, can be handled by a single assistant if desired, in some instances it may be preferable to use two assistants. Such transfer operation, however, is highly desirable since all of the lifting and transferring of the patient is borne primarily by its lifting posts provided on the wheelchair, and thus the assistants are not subjected to undesired lifting and consequent back strain. This wheelchair and its lifting capability, and its capability of transferring patients, not only provides for improved safety of the patient or occupant, but also improves the safety for the assistant.

Description of FIGS. 9–13

FIGS. 9–13 illustrate a second variation of a wheelchair 10' according to the present invention. This wheelchair 10' incorporates many of the same structural and functional relationships which are possessed by the wheelchair 10 of FIGS. 1–8, and corresponding parts thereof have been designated by the same reference numerals but with the addition of a prime (') thereto. Because of the similarity of the structure and function, these corresponding parts will not again be described in detail.

Figure 9:
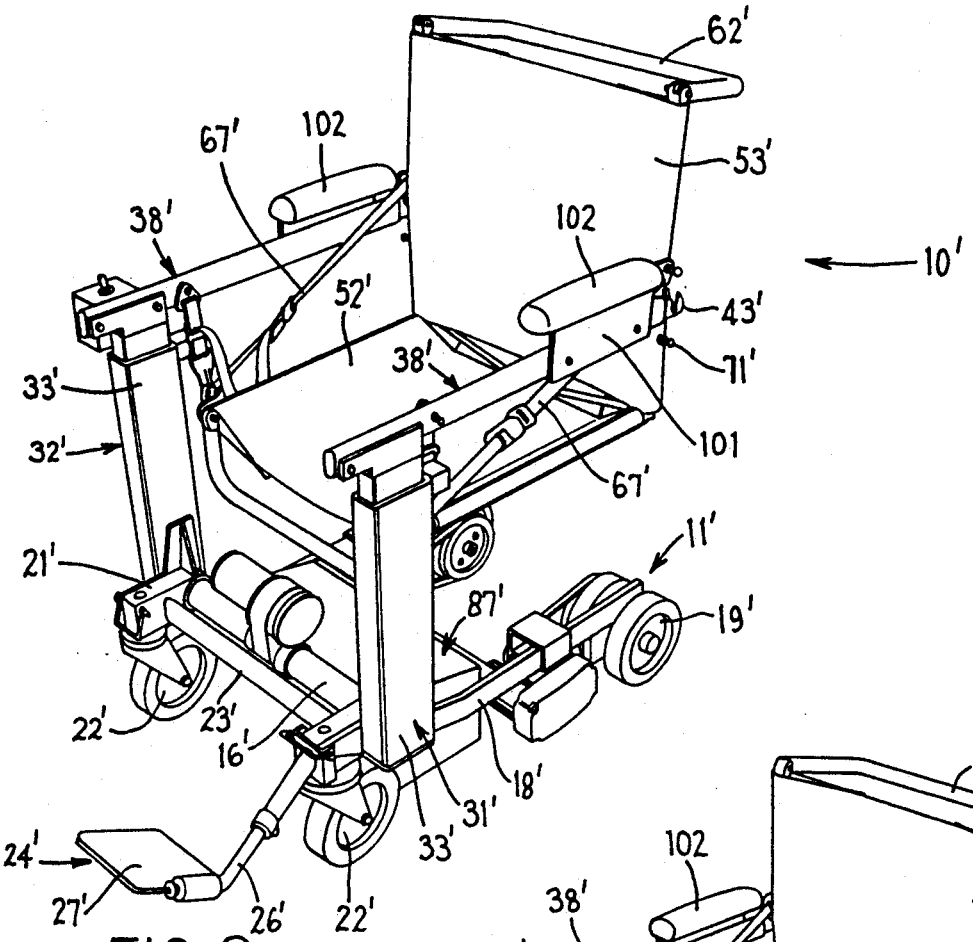
FIG. 9 is a perspective view showing a second variation of the wheelchair in its lowered position.
Figure 10:
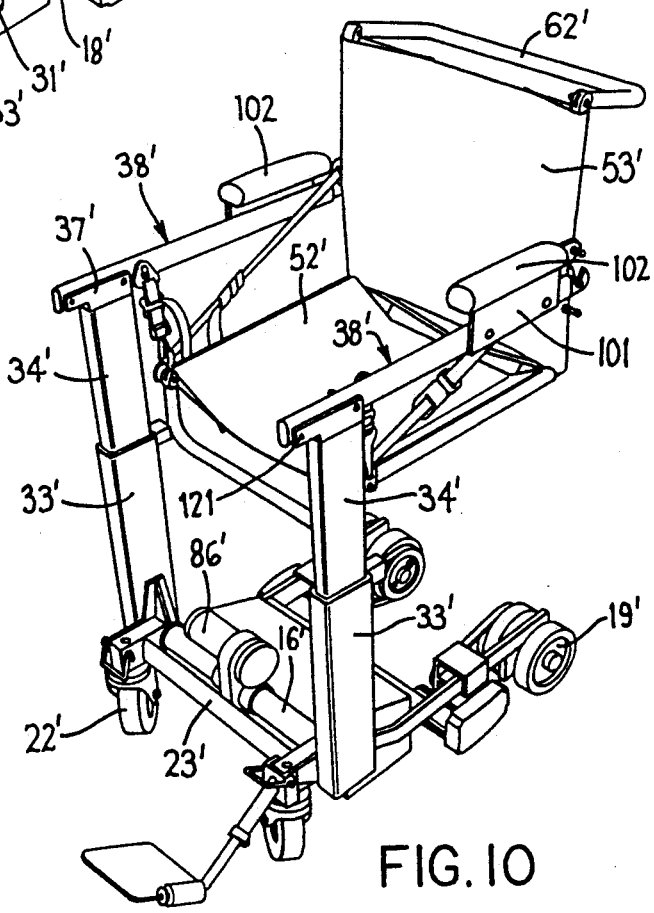
FIG. 10 shows the wheelchair of FIG. 9 in its upper position.

The wheelchair 10' is intended primarily for use in facilitating the movement of a handicapped person within the home, and the movement of such person to and from a vehicle, and through commercial businesses such as department stores and the like. For this reason, the wheelchair 10' is of slightly smaller construction. For example, the elevating support post assemblies 31' and 32' provide for a smaller vertical lift, as illustrated by FIG. 9, then the wheelchair 10. Further, the overall width of the wheelchair 10' is smaller so as to enable movement through most residential doorways. In fact, the wheelchair 10' has a maximum width, as measured between the outside surfaces of the posts 33', which is slightly less than 24 inches so as to permit movement through doorways having a width of 24 inches or more.

In addition, the rearwardly projecting cantilevered support arms 38' are normally straight so as to project horizontally rearwardly from the top of the post arrangements, and the elevation of the arms 38' is such that, when the post arrangement is in a lowermost position illustrated by FIG. 9, the arms 38' will be positionable beneath a table of standard height. To provide an arm rest of more convenient height for the chair occupant, the support arms 38' have, adjacent the rearward free ends thereof, arm rest brackets 101 which project upwardly and mount thereon cushioned arm rests 102 so as to provide comfortable supports for the occupant's arms. These arm rests 102 preferably project forwardly from the rear free end of the arms through a distance equal to no more than about one-half the length of the support arms 38'.

This wheelchair 10' is also self-propelled. For this purpose an electric drive motor 105 is mounted on each of the rear support legs 18', which drive motor in turn drives a gear box 106. The latter has an output pulley 107 for driving a belt 108 which is engaged with a driven pulley 109 secured to the innermost wheel of the rear wheel assembly 19'. An identical such drive arrangement is provided on each lower rear rail 18' for driving each of the rear wheel assemblies 19'.

To control driving of the rear wheels 19', the control box 91' has a further joy-stick type potentiometer or switch 111 provided thereon. This switch 111 is a multiple position arrangement of conventional construction and, when moved forwardly, energizes both motors 105 to drive the wheelchair forwardly, and when moved rearwardly the motors are reversely energized so as to permit reverse movement of the wheelchair. When switch 111 is activated rightwardly, then only the motor 105 on left side rail 18' is energized to cause the wheelchair to turn to the right except that a sharp right turn also reversely energizes the motor for the right rear wheel, and similarly pushing of the switch 111 to the left energizes only the motor on the right side rail so as to cause the wheelchair to turn to the left except that a sharp left turn also reversely energizes the left rear wheel. The switch or control 111 can assume many conventional configurations, and hence is not described in greater detail.

The switch control box 91' is preferably removably attached within a mounting bracket secured to the outer upper side of the top posts 34', which bracket permits the control box 91' to be lifted upwardly and detached so as to minimize the overall width of the wheelchair and permit movement through doorways of minimal width.

The motors 105 are electrically connected to the power source 87' in a conventional manner.

The wheelchair 10' is also constructed so as to permit it to be readily disassembled into several primary components so as to facilitate its transportability, such as in an automobile. For example, while the seat assembly 13' is removable in the same manner as described above, the wheelchair 10' also permits the upright assembly 12' to be disconnected from the wheeled base assembly 11', and the upright assembly 12' can be partially folded for compact storage, as described below.

To permit disconnection between the upright and wheeled base assemblies, the side legs 18' of the base have support brackets 116 fixedly secured to the forward ends thereof, which support brackets 116 have forwardly projecting rectangular parts which define the front support legs 21' to which are mounted the front casters 22'. These legs 21' are rigidly joined together by the cross bar 23'. The support tube 16' is, in this instance, fixedly secured between and carried with the lower support posts 33' so that the support tube 16' remains with and comprises a part of the upright assembly 12' when the latter is disconnected from the base assembly.

To permit connection of the upright and base assemblies, each of the front support brackets 116 defines on the upper side thereof a rearwardly facing bearing recess 117 which is close to but slightly less than of 180 degree extent. This bearing recess has a diameter corresponding to the outer diameter of the hub 17*a* of the support bracket 17' so as to snugly accommodate the support bracket therein.

To permit rigid attachment of the upright assembly to the base assembly, each of the lower support posts 33' has a mounting plate 118 fixedly secured to the lower inner face thereof, which plate 118 is an integral part of bracket 17' and projects forwardly so as to overlap the side of the front support leg 21'. A securing pin 119 projects through aligned openings formed in the support plate 118 and the leg 21' so that this pin, in conjunction with the support of the tubes 16' within the bearing 117, rigidly secures the upright assembly to the base assembly.

Figure 11:
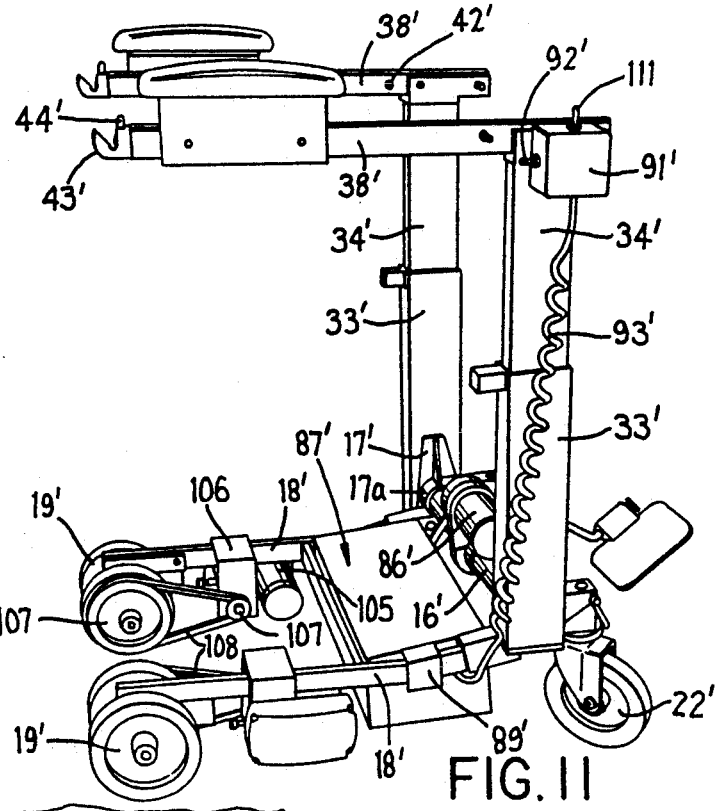
FIG. 11 shows the wheelchair of FIG. 9 with the seat assembly removed.
Figure 13:
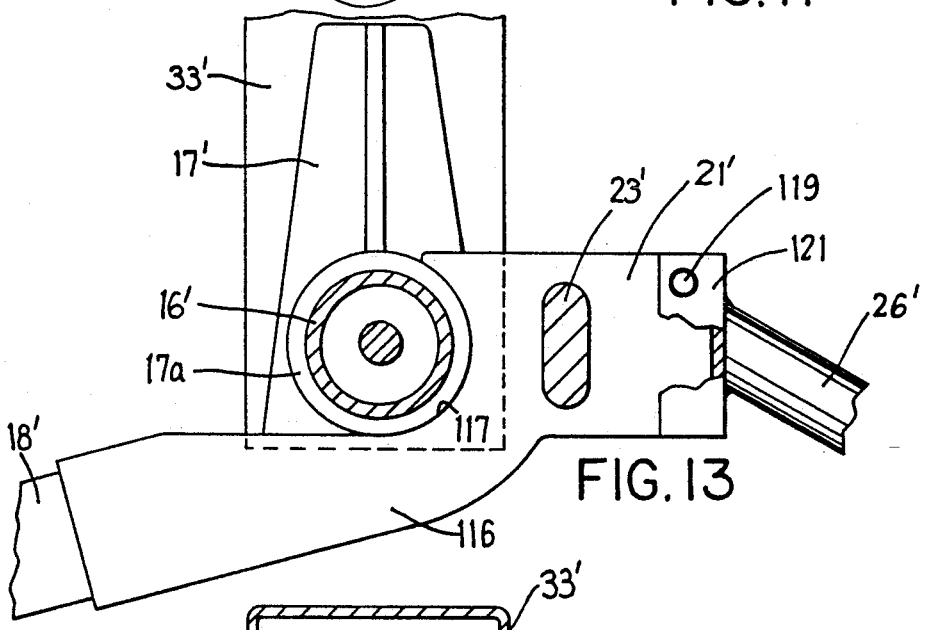
FIGS. 12 and 13 are enlarged, fragmentary sectional views showing the arrangement between the base and upright assemblies.
Figure 12:
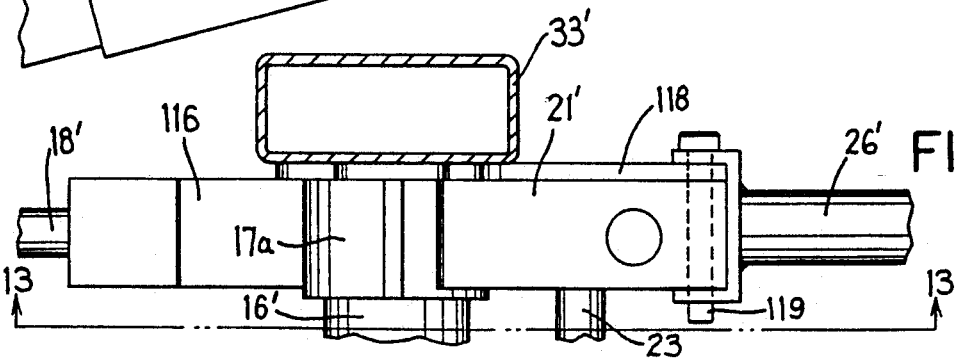

In the wheelchair 10', each of the footrest assemblies 24' is removably attached to a respective one of the front support legs 21'. For this purpose the support rod 26' of the footrest terminates in a channel-like bracket 121 which slidably telescopes downwardly over the nose or leading end of the leg 21' so that the plate 118 is sandwiched therebetween, as illustrated by FIG. 11. The securing pin 119 then extends through openings aligned in all three of the members as illustrated by FIG. 12 so as to fixedly secure them together.

With the wheelchair of the present invention, simply by removing each of the pins 119, which pins are suitably connected to the support leg 21' by a flexible anchoring cable, each of the foot supports 24' can be removed and the upright assembly 12' can be totally disconnected from the wheeled base assembly 11'. In addition, the power source 87' can also be removed from the wheeled base assembly to facilitate handling thereof.

To further facilitate compact storage of the upright assembly 12', the support brackets 37' at the upper ends of the post arrangements have elongated slots extending rearwardly thereof in which the arms 38' are securely supported. The outer ends of the arms 38', however, are hingedly coupled to the bracket 37' by a single hinge pin 120. Hence, when the upright assembly is disconnected from the base, the arms 38' can be pivoted upwardly and forwardly above the hinge pins 120 so as to permit their storage in generally parallel and overlapping relationship with the respective upright post arrangement.

The wheelchair 10' is designed and intended to operate in substantially the same manner as described above relative to the wheelchair 10 in that it can be utilized to permit transfer of an occupant from the chair to a bed or other support, or vice versa, by permitting removal or attachment of the seat assembly. Further, the provision of the vertically telescopic post assemblies enables the seat, when occupied, to be vertically elevated so that the occupant can be at a higher elevation to facilitate access to cupboards or the like, or visibility through windows.

At the same, with the support post assemblies in their lower position, the support arms enable the wheelchair to be moved upwardly and partially under a conventional table so as to be used at mealtimes and the like. In addition, the occupant has the ability to readily propel themselves about a house inasmuch as the wheelchair is self-propelled and provides for maximum mobility.

In addition, the wheelchair 10' permits an occupant to be transferred to or from a vehicle. For example, in a manner similar to the operation described above relative to a bed, the wheelchair can be backed up into the open doorway of a vehicle inasmuch as the rear wheel assemblies 19' and the cantilevered rear support legs 18' can pass under a vehicle so that the seat assembly 13' can be positioned directly over a vehicle seat. By then lower the support posts so that the wheelchair seat rests directly on vehicle seat, the wheelchair seat can be disconnected and then swiveled about 90 degrees so as to be positioned directly on and over the vehicle seat, thereby permitting transporting of the occupant in the vehicle while maintaining the occupant seated on the wheelchair seat.

The wheelchair seat can then be removed from the vehicle and reconnected to the wheelchair in a generally similar but reverse sequence.

During transporting of the occupant within the vehicle, the wheelchair can be readily disassembled by removing the pins 119 and then folding the support arms 18' over whereby the folded upright assembly can then be stored in the vehicle, such as in the trunk. The power pack 87' is then removed from the wheeled base assembly, and the wheeled base assembly and power pack can then also be individually handled and conveniently stored in the vehicle, such as in the trunk. To facilitate this disassembly, all of the electrical cables, where they connect to the power source 87', preferably employ conventional separable pluglike connections.

FIGS. 14–17 illustrate a third variation which relates specifically to a modified seat assembly 13" which can be used in place of the seat assembly 13 or 13' illustrated by the above-described embodiments. This modified seat assembly 13" mounts on the wheelchair in the same manner previously described, and thus further details of the wheelchair have been omitted in FIGS. 14–17. The seat assembly 13" again includes a seat portion 52" which is hingedly joined to a backrest portion 53".

Figure 15:
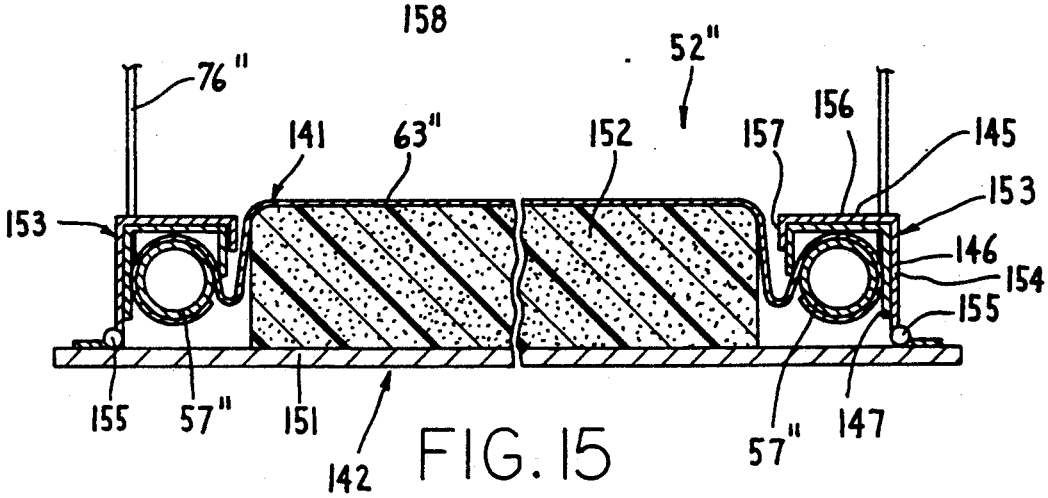
FIG. 15 is an enlarged sectional elevational view taken transversely (i.e., sidewardly) through the seat structure of FIG. 14 when in an assembled condition.

The seat portion 52" is of a separable laminate or multi-layer construction in that it includes upper and lower seat subassemblies 141 and 142, respectively, which are directly engaged one above the other when in an assembled condition as illustrated by FIG. 15. The upper seat subassembly 141 is defined generally by a flexible seatlike support or covering 63" which extends between and is suitably fixedly anchored along opposite side edges thereof to the side rails 57". This support or covering 63" is made of a generally nonstretchable but flexible material such as nylon, plastic or other generally waterproof clothlike or fabric-like material. The seat support 63" is provided with sufficient looseness to permit a small amount of downward sag when left unsupported. The support 63" also has an enlarged generally elongate or oval opening 143 positioned centrally thereof and opening vertically downwardly therethrough.

In the illustrated embodiment, each side rail of the upper seat subassembly 141 also preferably has a generally L-shaped member 144 fixed thereto and extending longitudinally therealong throughout substantially the front-to-back extent of the covering 63". This L-shaped member 144, as illustrated by FIG. 15, overlies the edge portion of the flexible covering which wraps around the frame rail 57" so that the edge portion of the covering is sandwiched therebetween. This edge member 144 includes a generally horizontal top leg or wall 145 joined to a vertical wall or leg 146 which projects downwardly adjacent the outer side of the frame rail.

Considering now the lower seat subassembly 142, it is designed to releasably attach to the subassembly 141 in the manner illustrated by FIG. 15 to permit normal use of the wheelchair, with this subassembly 142 being releasable from the upper seat subassembly 141 when use of the wheelchair in association with a toilet is desired.

The lower seat subassembly 142 includes a base 151 which is of a horizontally enlarged platelike construction and is preferably of a rigid and strong material, such as a suitable plastics material. This base has secured to an upper surface thereof a horizontally enlarged seat cushion 152, the latter having a horizontal size which substantially corresponds to that of the covering 63". This cushion 152 possesses suitable resilience as to permit comfortable seating of the wheelchair occupant, and may be constructed of a suitable resilient foam, resilient gel, or other material having suitable properties.

The subassembly 142 also has a pair of releasable coupling or clamping assemblies 153 mounted adjacent and extending longitudinally along each side edge of the base 151. These coupling assemblies 153 are identical except for being mirror images of one another and are thus disposed substantially symmetrically relative to a central vertical plane extending longitudinally through the seat portion 52". These clamping assemblies 153 are disposed directly adjacent and extend longitudinally along the opposite side edges of the cushion 152, and each includes an elongate one-piece coupling or clamping member which is of generally L or channel-shaped cross section and includes a base leg 154 (FIG. 15) which along one edge joins to an elongate hinge 155 (such as a piano-type hinge) mounted directly adjacent the upper surface of the base 151. Base leg 154 at its other edge is rigidly joined to an outer leg 156 which extends in perpendicular relationship to the leg 154, and which at its other edge is provided with a small downwardly directed flange 157 which projects away from the outer leg 156 in the same direction as the base leg 154 and in substantially parallel relationship therewith. This hence provides the clamping member 153 with a shallow downwardly-oriented channel when the clamping member is in the engaged or holding position illustrated by FIG. 15. The channel-like configuration of the clamping member 153 enables it to be positioned over and engaged with the respective side seat rail 57", specifically by nesting downwardly over the L-shaped member 144.

Figure 14:
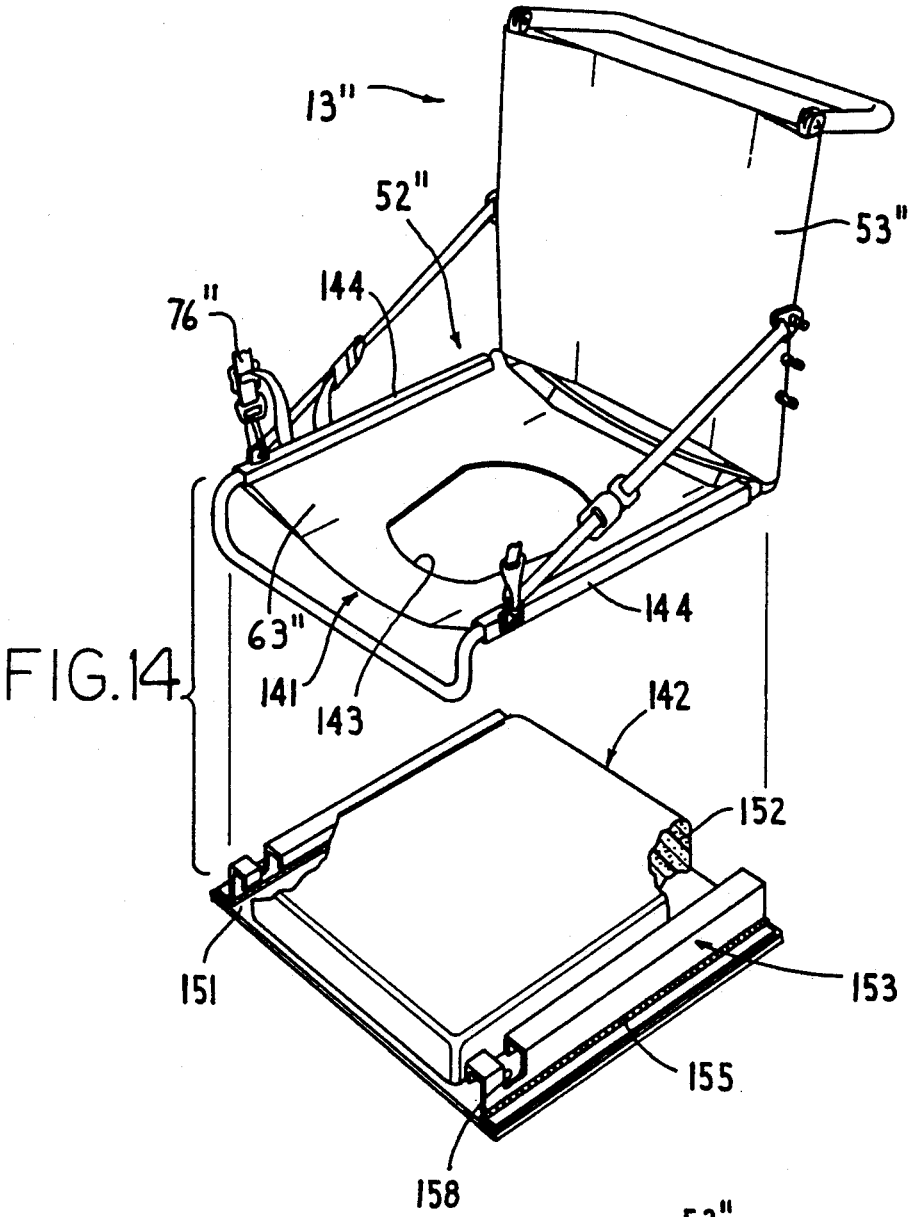
FIG. 14 is an exploded perspective view of a modified seat structure for use with the wheelchair as described in the aforementioned embodiments.
Figure 16:
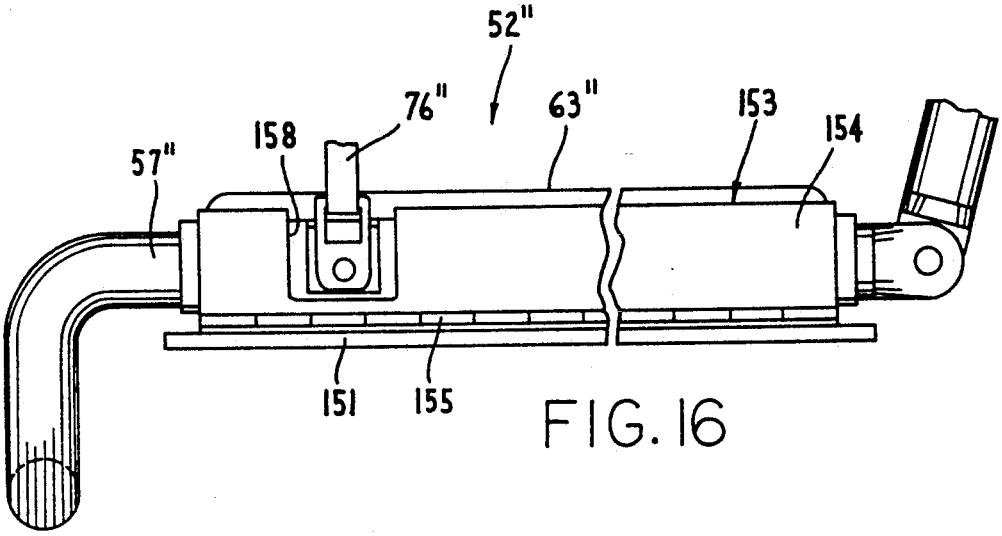
FIG. 16 is a right side elevational view of the seat structure shown in FIG. 15.

As illustrated by FIGS. 14 and 16, this clamping member 153, in the vicinity of the front end of the seat portion, is provided with a recess or cutout 158 for accommodating the connection of the suspending strap to the seat side rail.

Figure 17:
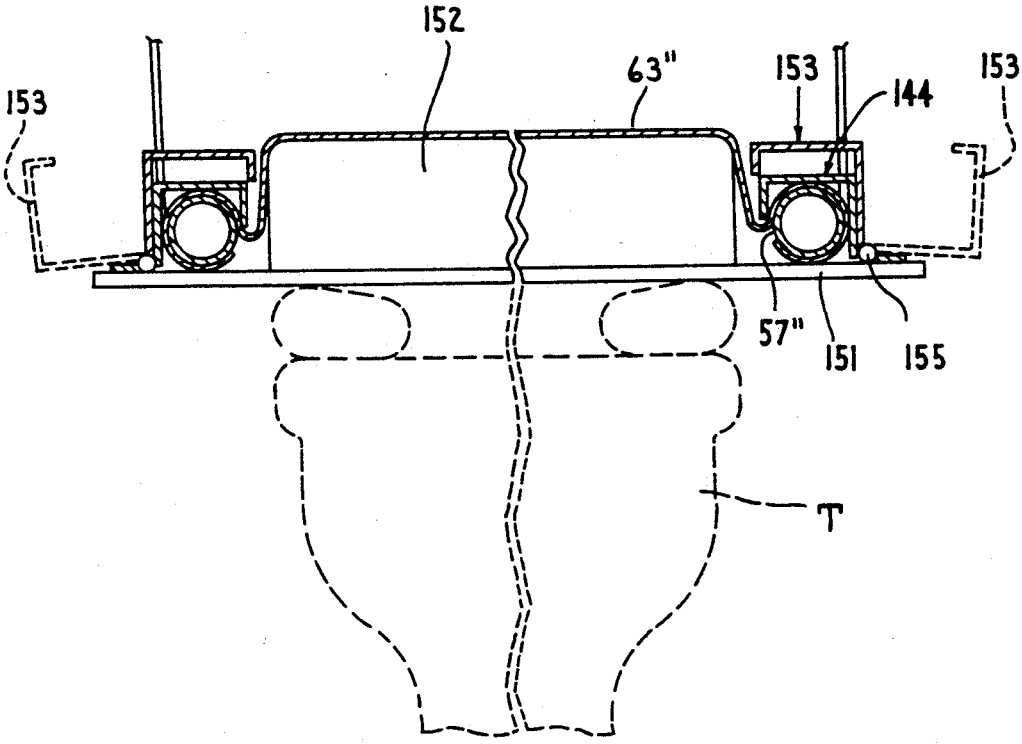
FIG. 17 is a view similar to FIG. 15 but illustrating the seat structure in the position where it is supported on a toilet so as to permit release of the lower seat portion.

The clamping members 153 are movable between the engaged positions substantially as illustrated by solid lines in FIG. 15, and the released position as illustrated by dotted lines in FIG. 17. This movement between the engaged and released positions occurs due to a pivoting of the respective clamping member 153 about the respective hinge 155 through an angle of about 90°.

Referring now to FIG. 15, this illustrates the seat portion 52" in the fully assembled position assumed when unoccupied and when mounted on the wheelchair. In this assembled condition the clamping members 153 are pivoted upwardly so as to engage and nest around the side frame rails, and at the same time the cushion 152 on the subassembly 142 projects upwardly between the opposite side frame rails 57" so as to engage and in fact effect some upwardly displacement of the covering 63". Further, the cushion 152 extends completely across the opening 143 formed in the covering 63" to hence provide a substantially continuous and comfortable seat.

When an occupant is seated in the wheelchair, the weight of the occupant is imposed through the covering 63" onto the cushion 152, which tends to urge the lower subassembly 142 downwardly, thereby maintaining the seat portion 52" in the assembled condition illustrated by FIG. 15.

When it is desirable to use the wheelchair in conjunction with a standard toilet, the wheelchair can be positioned in a forwardly-facing orientation directly in front of the toilet, and then rolled backwardly so as to straddle the toilet, such being permitted by the open U-shaped configuration of the wheelchair base and the clearance between the base and the seat assembly. During this initial positioning of the wheelchair in straddling relationship to the toilet, the seat assembly 13" is disposed at a sufficient elevation as to vertically clear the toilet.

After the wheelchair has been positioned so that the seat assembly 52" is spaced upwardly from but generally directly over the toilet, then the entire seat assembly 13" is lowered by effecting powered lowering of the front support posts (such as posts 32 in FIG. 1 or posts 32' in FIG. 9) until the base 151 contacts the upper surface of the toilet substantially as illustrated by the toilet T shown in dotted lines in FIG. 17. This lowering of the seat assembly will continue until the occupant's weight is transmitted through the seat assembly onto the toilet, thus resulting in significant relieving of the tension loads associated with the suspending straps 76" secured to the seat assembly. Since the downward weight of the occupant as imposed on the seat assembly is now transmitted through the cushion 152 and the base 151 directly onto the toilet, the upper and lower subassembly 141 and 142 now assume a relationship substantially as illustrated by FIG. 17 in that the clamping members 153 are displaced slightly upwardly relative to the L-shaped side rails 57", 144. This now permits either the wheelchair occupant or an attendant, to manually engage each of the clamping members 153 and easily manually swing them outwardly into a release position substantially as illustrated by dotted lines in FIG. 17.

Thereafter the wheelchair posts (32 or 32') are activated so as to lift the seat assembly 13" upwardly at least several inches so that the upper seat subassembly 141 is thus separated from and spaced upwardly from the lower seat subassembly 142, the latter remaining freely supported on the top of the toilet. During this upward movement of the seat assembly 13", the weight of the occupant will now be borne entirely by the covering 63". The lower subassembly 142 is then manually removed, such as by grasping and moving the subassembly 142 sidewardly from beneath the upper subassembly 141, and then temporarily storing the removed subassembly 142 in close proximity to the wheelchair. The wheelchair posts (32 or 32') are then again lowered so as to lower the seat assembly 13" until the covering 63" rests on or is positioned in close proximity to and directly over the toilet. This enables the wheelchair occupant to utilize the toilet, due to the presence of the opening 143 in the covering 63", without having to be removed from the wheelchair.

After use of the toilet has been completed, the seat portion 52" is reassembled in a reverse manner to the procedure outlined above.

The arrangement described above enables a wheelchair occupant to utilize a conventional toilet, and permits such use to occur without requiring transfer of the occupant between the wheelchair and the toilet. This permits a more convenient and more safe utilization of a conventional toilet, and permits such use to occur by the occupant, although more generally with the assistance of an attendant. Such assistance of the attendant, however, is limited more to assisting the general operation, including assisting in the removal and reattachment of the lower subassembly 142. The attendant is not required to exert undo stress or effect undo lifting since transfer of the occupant from the wheelchair to the toilet, and back again, is not required. Thus, the overall safety of the occupant and attendant is greatly enhanced.

Figure 18:
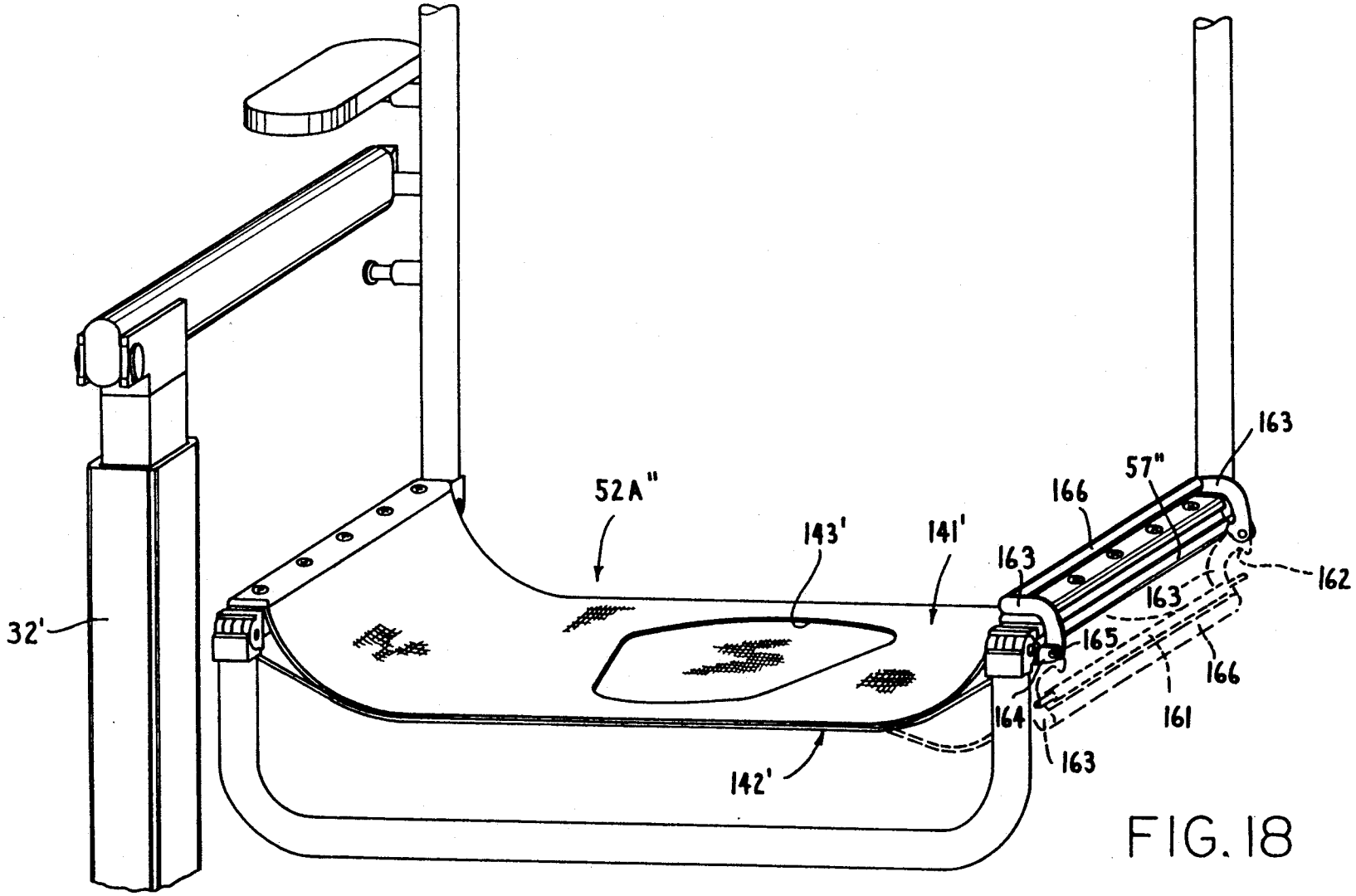
FIG. 18 illustrates a further variation of the wheelchair seat structure.

Referencing now FIG. 18, there is illustrated a variation of the seat portion which is associated with the seat assembly for use with the wheelchair to permit the latter to be used in conjunction with a conventional toilet. In this variation, the seat portion 52A" again includes upper and lower seat subassemblies 141' and 142', and the upper subassembly 141' is identical to the previously described subassembly 141 in that it comprises a flexible sheetlike layer of fabric or plastic having opposite edges anchored to the seat side frames and provided with a central opening 143' therethrough. In this variation, however, the lower seat subassembly 142' is also formed from a layer of flexible sheetlike material so as to underlie the upper layer 141'.

More specifically, the lower subassembly 142' includes a thin sheetlike layer of a flexible material such as plastic, fabric or the like which extends transversely between the opposite side frame rails 57" and substantially coextensively underlies the upper layer 141' when the lower layer 142' is in the engaged position, whereby the two layers are superimposed and function as a seat for the occupant. This lower layer 142' has one side edge portion thereof fixedly anchored to one of the side frame rails, such as the rail on the left side in FIG. 18. The other side edge portion of the lower layer 142' has a rodlike stiffener element 161 stitched in the side edge portion thereof so as to extend generally parallel with the adjacent side frame rail, and the ends of this stiffener rod project out of the fabric and are adapted to be releasably positioned within notches 162 formed in a pair of over-center latching levers 163. A pair of mounting brackets 164 are provided on the respective side frame rail adjacent the front and rear ends thereof, and each bracket pivotally mounts at 165 one end of a respective said latching lever 163. The other or free ends of the latching levers are joined by a rod or bar 166 which functions as a handle.

With this variation of the seat portion 52A", the ends of stiffener rod 161 are inserted in the notches 162 and the over-center latch 163, 166 is then manually swung upwardly (counterclockwise in FIG. 18) through an angle which approaches 180° until the latch levers 163 abut stops associated with the mounting flanges. This over-center arrangement results in the lower layer 142' being effectively tensioned and latched so as to be superimposed and engaged directly under the upper layer 141 so that the two layers function as a seat to permit support of a wheelchair occupant thereon.

When this device is to be used with a toilet, the wheelchair is again backed over a toilet and the seat positioned thereabove. The upright posts are lowered until the seat portion engages the toilet and relieves the tension on the superimposed layers of the seat portion, following which the latch assembly 163, 166 is manually swung outwardly and downwardly into the release position shown by dotted lines. The upright post assemblies of the wheelchair are then move upwardly so that the upper fabric layer 141 is lifted upwardly and now assumes the entire weight of the occupant, following which the ends of the stiffener rod 161 are removed from the notches 162, and the lower layer 142' is then manually displaced sidewardly (leftwardly in FIG. 18) to move it out from between the seat and toilet, whereupon this layer 142' can then be suspended downwardly directly along one side of the toilet. The post assemblies of the wheelchair are again lowered so that the remaining seat layer 142' can then be suspended downwardly directly over or supported directly on the toilet. The seat portion 52A" of the wheelchair is thereafter reattached by reversing the aforedescribed sequence.

While the improved seat arrangement described above has been disclosed and is highly preferable for use on a wheelchair to permit utilization thereof in conjunction with a toilet, it will be appreciated that this improved seat arrangement is also usable on other types of mobile patient lifts or transports so as to permit utilization of the lift or transport in conjunction with a conventional toilet without requiring removal of the occupant or patient from the lift or transport.

Further, while two variations of the disengagable lower seat subassembly have been described above, it will also be apparent that numerous other variations are suitable for accomplishing the desired objective. For example, the lower seat subassembly can be provided by what may be referred to as a "trap door" arrangement. With such arrangement, the lower base member 151 of FIG. 14 can be defined by two rigid members each having a cushion portion on the upper surface thereof, with these members having outer edges hinged adjacent the side frame rails. A latching arrangement can be provided for normally maintaining the two doors coplanar under the upper seat member, with release of the latch enabling the two doors to swing downwardly and outwardly in opposite directions so as to effectively straddle the toilet.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A wheelchair, such as for transporting an invalid or handicapped person, comprising:

a wheeled base assembly having a front, a rear and two sides;

an upright assembly mounted to and projecting upwardly from said base assembly, said upright assembly including a pair of upright post arrangements positioned adjacent opposite sides of said base assembly, said post arrangements being vertically extendible and retractable;

drive means drivingly coupled to said post arrangements for effecting raising and lowering thereof;

said upright assembly including a pair of elongate support arms mounted on said post arrangements adjacent upper ends thereof, said support arms being disposed adjacent opposite sides of said wheelchair and extending in generally horizontal and generally parallel relationship;

a seat assembly attached to said upright assembly and positioned between said support arms, said seat assembly including a seat portion which defines thereon an enlarged upwardly facing surface which is provided for engaging an occupant for permitting support of an occupant on the seat portion, said seat portion being positioned generally downwardly from the elevation of said support arms;

said seat portion having means associated therewith for permitting said seat portion to be positioned directly over and used in conjunction with a conventional toilet without requiring removal of the occupant from the wheelchair, said means including upper and lower seat subassemblies which are normally positioned in vertically superimposed relationship for supporting the wheelchair occupant, said upper subassembly including a horizontally enlarged seat member which defines thereon said upper surface and which has a large opening positioned centrally thereof and extending vertically therethrough, and said lower subassembly including an enlarged support member which is normally positioned in direct vertical superimposed relationship with said seat member for direct supportive engagement with an underside of said seat member, and releasable coupling means cooperating between said lower subassembly and said upper subassembly for permitting movement of said lower subassembly between an engaged support position wherein said support member is superimposed under said seat member and a released position, said releasable coupling means including means permitting the lower seat assembly in the released position to be manually moved to a laterally-spaced position so that the opening in the seat member can be aligned directly over and in direct communication with a conventional toilet.

2. A wheelchair according to claim 1, wherein said seat member comprises a thin, flexible, sheetlike member.

3. A wheelchair according to claim 2, wherein said lower subassembly includes a generally rigid base member, said support member comprising a horizontally enlarged cushion member having at least limited resiliency, said cushion member being stationarily mounted on and projecting upwardly from said base member for supportive engagement with the underside of said seat member.

4. A wheelchair according to claim 3, wherein said seat portion includes frame rails disposed adjacent opposite sides of said seat portion, said seat member being anchored to said frame rails and extending therebetween, said releasable coupling means including latch arrangements which cooperate between opposite edge portions of said base member and said frame rails for permitting said lower subassembly to be wholly disconnected from said frame rails so that said lower subassembly can be wholly manually removed from beneath said seat member.

5. A wheelchair according to claim 4, wherein said latch arrangements are releasable by first lowering the assembled seat.-portion, onto the toilet so that the occupant's weight is at least partially transferred directly downwardly through the upper and lower sub-assemblies directly to the toilet, following which the latch arrangements are released and the upper seat subassembly raised to permit removal of the lower seat subassembly.

6. A wheelchair according to claim 5, wherein said seat portion is at least partially supported from said upright assembly by suspension members which permit at least limited upward displacement of the seat portion relative to the upright assembly when the seat portion is lowered into engagement with the toilet.

7. A wheelchair according to claim 2, wherein said support member also comprises a thin, flexible, sheetlike member which extends in direct supportive engagement under said seat member and closes off the opening in said seat member.

8. A wheelchair according to claim 7, wherein said seat portion includes a pair of frame rails disposed adjacent opposite sides thereof, said seat member extending between and having opposite edge portions thereof anchored to said frame rails, said support member having one edge portion thereof anchored to one said frame rail, and said releasable coupling means cooperating with an opposite edge portion of said support member and the other said frame rail for releasably anchoring said opposite edge portion thereto.

9. A wheelchair according to claim 8, wherein said seat portion is at least partially supported from said upright assembly by suspension members which permit at least limited upward displacement of the seat portion relative to the upright assembly when the seat portion is lowered into engagement with the toilet.

10. A wheeled transport, such as for transporting an invalid or handicapped person, comprising:

a wheeled base assembly;

an upright assembly projecting upwardly from said base assembly, said upright assembly including a lower portion which is mounted to said base assembly and an upper portion supported for vertical movement relative to the lower portion;

drive means associated with said upright assembly for effecting raising and lowering of said upper portion;

a seat assembly attached to the upper portion of said upright assembly, said seat assembly including a seat portion which defines thereon an enlarged upwardly facing surface which is provided for engaging an occupant for permitting support of an occupant on the seat portion;

said seat portion having means associated therewith for permitting said seat portion to be positioned directly over and used in conjunction with a conventional toilet without requiring removal of the occupant from the seat assembly, said means including upper and lower seat subassemblies which are normally positioned in vertically superimposed relationship for supporting the occupant, said upper subassembly including a horizontally enlarged seat member which defines thereon said upper surface and which has a large opening positioned centrally thereof and extending vertically therethrough, and said lower subassembly including an enlarged support member which is normally positioned in direct vertical superimposed relationship with said seat member for direct supportive engagement with an underside of said seat member, and releasable coupling means cooperating between said lower subassembly and said upper subassembly for permitting movement of said lower subassembly between an engaged support position wherein said support member is superimposed under said seat member and a released position which permits the lower subassembly to be manually moved to a laterally-spaced position so that the opening in the seat member can be aligned directly over and in direct communication with a conventional toilet, said coupling means including means for facilitating release thereof when the seat portion is lowered so that the lower subassembly directly engages and presses downwardly on the toilet.

11. A transport according to claim 10, wherein said seat member comprises a thin, flexible, sheetlike member.

12. A transport according to claim 11, wherein said support member comprises a thin, flexible, sheetlike member which extends in direct supportive engagement under said seat member and closes off the opening in said seat member when in said support position.

13. A transport according to claim 11, wherein said seat portion includes a pair of frame rails disposed adjacent opposite sides thereof, said seat member extending between and having opposite edge portions thereof anchored to said frame rails.

14. A transport according to claim 11, including suspension means cooperating between said upper portion and said seat assembly for at least partially vertically supporting said seat assembly in a suspended state from said upper portion.

15. A process for permitting an invalid or handicapped person to utilize a conventional toilet, comprising the steps of:

providing a wheeled transport having a wheeled base and a vertically-movable seat assembly mounted on the base in upwardly-spaced relationship therefrom so as to permit an occupant to be seated on the seat assembly;

providing the seat assembly with an upper seat member having an enlarged upper surface for providing supportive engagement with the buttocks of an occupant, said upper seat member having an enlarged central opening projecting vertically therethrough;

providing a lower seat subassembly normally disposed in supportive and in superimposed engagement directly under said upper seat member for normally permitting the weight of the occupant to be transmitted through the upper seat member directly onto the lower seat subassembly, the lower seat subassembly being movable into a nonsupportive and nonload bearing position relative to the upper seat member, said lower seat subassembly extending across and effectively closing off the opening in the upper seat member;

positioning an occupant on the seat assembly so that the weight of the occupant is transmitted through the upper seat member onto the lower seat subassembly;

positioning the seat assembly with the occupant seated thereon directly vertically over and spaced vertically upwardly from a conventional toilet;

vertically lowering the seat assembly and the occupant thereon until the lower seat subassembly contacts the toilet and effects at least limited upward displacement of the upper seat member and occupant relative to a part of the transport;

disconnecting the lower seat subassembly from the upper seat member while the lower seat subassembly is maintained in vertical force-transmitting engagement with the toilet;

thereafter vertically raising said upper seat member and the occupant therein upwardly away from the toilet so that the weight of the occupant is borne entirely by the upper seat member and the upper seat member is spaced upwardly from the lower seat subassembly;

manually displacing the lower seat subassembly laterally so that it is no longer positioned over the toilet; and then positioning the upper seat member and the occupant therein so that the upper seat member is positioned closely adjacent and directly over the toilet so that the opening in the upper seat member is aligned with and in direct communication with the toilet.

16. A method according to claim 15, wherein said upper seat member is constructed of a thin, flexible, sheetlike material which extends between a pair of space-apart frame elements, and wherein the tension in this upper seat member due to presence of an occupant is relieved when the assembled upper seat member and lower seat subassembly are initially moved downwardly into engagement with the upper surface of the toilet so as to permit disengagement of the lower seat subassembly from the upper seat member.

17. A wheelchair, such as for transporting an invalid or handicapped person, comprising:

a wheeled base assembly;

an upright assembly fixedly secured to and projecting upwardly from said base assembly, said upright assembly including a pair of upright post arrangements located adjacent opposite sides of said base assembly and generally adjacent front corners of the wheelchair, each said post arrangement being vertically extendible and retractable;

drive means drivingly coupled to said post arrangements for effecting simultaneous vertical movement thereof;

said upright assembly including a pair of elongate and sidewardly-spaced support arms which are mounted to said posit arrangements adjacent upper ends thereof, said support arms projecting rearwardly from said post arrangements in generally parallel relationship;

a seat arrangement positioned sidewardly between and removably attached to said support arms, said seat arrangement including a generally horizontally enlarged seat portion and a backrest portion which projects upwardly in transverse relationship to the seat portion, said seat portion being positioned at an elevation below said support arms and projecting rearwardly away from said post arrangements, said backrest portion being joined to a rear edge of said seat portion so as to be spaced rearwardly a substantial distance from said upright post arrangements, said seat arrangement opening forwardly between said post arrangements for accessibility from a front side of the wheelchair; and releasable support means coacting between said upright assembly and said seat arrangement for permitting said seat arrangement to be disconnected from said upright assembly by relative vertical movement therebetween.

18. A wheelchair, such as for transporting an invalid or handicapped person, comprising:

a wheeled base assembly;

an upright assembly fixedly secured to and projecting upwardly from said base assembly, said upright assembly including a pair of upright post arrangements located adjacent opposite sides of the base assembly and generally adjacent front corners of the wheelchair, each said post arrangement being vertically extendable and retractable;

drive means drivingly coupled to said post arrangements for effecting simultaneous vertical movement thereof;

said upright assembly including a pair of elongate and sidewardly-spaced support arms which are mounted to said posit arrangements adjacent upper ends thereof, said support arms projecting rearwardly from said post arrangements in generally parallel relationship;

a seat arrangement positioned sidewardly between and removably attached to said support arms, said seat arrangement including a generally horizontally enlarged seat portion and a backrest portion which projects upwardly in transverse relationship to the seat portion, said seat portion being positioned at an elevation below said support arms and projecting rearwardly away from said post arrangements, said backrest portion being joined to a rear edge of said seat portion so as to be spaced rearwardly a substantial distance from said upright post arrangements, said seat arrangement opening forwardly between said post arrangements for accessibility from a front side of the wheelchair; and first manually releasable means coact between opposite sides of said seat arrangement and the respective support arms adjacent rearward free ends thereof to effect partial support of said seat arrangement on said support arms, and second manually releasable means cooperating between opposite sides of said seat portion and the respective support arms adjacent the forward ends thereof to effect partial support of said seat arrangement.

19. A wheelchair according to claim 18, wherein said second releasable means includes an adjustable length connector.

20. A wheelchair according to claim 18, wherein the first releasable means comprises catch means which coacts directly with opposite sides of said backrest portion.

21. A wheelchair according to claim 17, wherein said releasable support means coacts directly between said support arms and respectively adjacent sides of said seat arrangement at two locations which are disposed adjacent each side of the seat arrangement and which are significantly spaced apart from one another in the front-to-back direction of the seat arrangement.

22. A wheeled transport, such as for transporting an invalid or handicapped person, comprising:

a wheeled base assembly;

an upright assembly projecting upwardly from said base assembly, said upright assembly including a lower portion which is mounted to said base assembly and an upper portion supported for vertical movement relative to the lower portion;

drive means associated with said upright assembly for effecting raising and lowering of said upper portion;

a seat assembly attached to the upper portion of said upright assembly, said seat assembly including a seat portion which defines thereon an enlarged upwardly facing surface which is provided for engaging and supporting an occupant on the seat portion;

said seat portion having means associated therewith for permitting said seat portion to be positioned directly over and used in conjunction with a conventional toilet without requiring removal of the occupant from the wheelchair, said means including upper and lower subassemblies which are normally positioned in directly and vertically superimposed relationship, said upper subassembly including a horizontally enlarged seat member which defines thereon said upper surface and which has a large opening positioned centrally thereof and extending vertically therethrough, said lower subassembly including an enlarged support member which is normally positioned directly vertically adjacent and directly under said seat member for closing off said large opening; and releasable coupling means cooperating between said upper and lower subassemblies for normally maintaining said lower subassembly in a storage position wherein the lower subassembly is superimposed directly under the upper subassembly for closing off said large opening, said releasable coupling means including means for facilitating release of said lower subassembly from said upper subassembly and permitting said lower subassembly to be manually moved to a laterally-spaced position so that the large opening in the seat member is uncovered and can be aligned directly over and in direct communication with a conventional toilet.

23. A transport according to claim 22, wherein said releasable coupling means includes releasable latch means which cooperate between said upper and lower subassemblies adjacent one edge of said seat portion for normally holding said lower subassembly in said storage position, and said coupling means cooperating between said upper and lower subassemblies adjacent another edge of said seat portion for maintaining said upper and lower subassemblies coupled together while permitting said lower subassembly to be manually moved from the storage position into said laterally-spaced position.

* * * * *

UNITED STATES PATENT AND TRADEMARK OFFICE

CERTIFICATE OF CORRECTION

PATENT NO. : 5 255 934

DATED : October 26, 1993

INVENTOR(S) : Harold R. Wilson

It is certified that error appears in the above-identified patent and that said Letters Patent is hereby corrected as shown below:

Column 18, line 20; change "seat.-portion," to
---seat portion---.

Column 20, line 56; change "said" to ---the---.
line 65; change "posit" to ---post---.

Column 21, line 35; change "posit" to ---post---.

Column 22, line 31; change "wheelchair," to
---seat portion,---.
line 53; change "the seat" to ---said seat---.

Signed and Sealed this

Seventeenth Day of May, 1994

Bruce Lehman

*Attest:*

BRUCE LEHMAN

*Attesting Officer*

*Commissioner of Patents and Trademarks*